US010533417B2

(12) United States Patent
Wicks et al.

(10) Patent No.: US 10,533,417 B2
(45) Date of Patent: Jan. 14, 2020

(54) NON-CAKING MINE ROCK DUST FOR USE IN UNDERGROUND COAL MINES

(71) Applicant: Imerys USA, Inc., Roswell, GA (US)

(72) Inventors: Douglas Wicks, Plymouth, MN (US); Christopher Paynter, Atlanta, GA (US); Jean-Andre Alary, L'Isle sur la Sorgue (FR); Dickey S. Shurling, Sandersville, GA (US); David Anstine, Canton, GA (US)

(73) Assignee: Imerys USA, Inc., Roswell, GA (US)

( * ) Notice: Subject to any disclaimer, the term of this patent is extended or adjusted under 35 U.S.C. 154(b) by 47 days.

(21) Appl. No.: 15/432,789

(22) Filed: Feb. 14, 2017

(65) Prior Publication Data

US 2017/0159437 A1 Jun. 8, 2017

Related U.S. Application Data

(63) Continuation of application No. 14/519,941, filed on Oct. 21, 2014, now abandoned, which is a continuation of application No. PCT/US2014/059536, filed on Oct. 7, 2014, and a continuation-in-part of application No. 14/151,004, filed on Jan. 9, 2014, now abandoned, and a continuation-in-part of application No. 14/281,610, filed on May 19, 2014, now Pat. No. 9,631,492.

(60) Provisional application No. 61/897,907, filed on Oct. 31, 2013, provisional application No. 61/750,564, filed on Jan. 9, 2013, provisional application No. 61/787,654, filed on Mar. 15, 2013.

(30) Foreign Application Priority Data

Oct. 7, 2013 (EP) ..... 13290240

(51) Int. Cl.
*E21F 5/12* (2006.01)
*E21F 5/08* (2006.01)

(52) U.S. Cl.
CPC . *E21F 5/12* (2013.01); *E21F 5/08* (2013.01)

(58) Field of Classification Search
None
See application file for complete search history.

(56) References Cited

U.S. PATENT DOCUMENTS

| | | | | |
|---|---|---|---|---|
| 2,668,749 | A | 2/1954 | McHan | |
| 3,415,774 | A | 12/1968 | Hood | |
| 3,595,317 | A | 7/1971 | Bell | |
| 4,019,918 | A | 4/1977 | Wills | |
| 4,190,456 | A | 2/1980 | Absolon et al. | |
| 4,222,857 | A * | 9/1980 | McCarthy | B03B 5/40 209/156 |
| 4,564,369 | A * | 1/1986 | Burgess | B03B 9/005 209/164 |
| 4,607,066 | A | 8/1986 | Barry | |
| 4,835,195 | A | 5/1989 | Rayfield | |
| 4,898,620 | A | 2/1990 | Rayfield et al. | |
| 5,238,193 | A | 8/1993 | Pearce | |
| 6,083,317 | A | 7/2000 | Snowden et al. | |
| 6,342,100 | B1 | 1/2002 | Nover et al. | |
| 6,569,527 | B1 | 5/2003 | Calhoun et al. | |
| 6,634,224 | B1 | 10/2003 | Schöb et al. | |
| 8,580,141 | B2 | 11/2013 | Khanna | |
| 2002/0032128 | A1 | 3/2002 | Kobayashi et al. | |
| 2003/0099828 | A1 | 5/2003 | Bundo et al. | |
| 2003/0146410 | A1 | 8/2003 | Gay et al. | |
| 2004/0185361 | A1 * | 9/2004 | Yoshino | G03G 13/26 430/108.1 |
| 2004/0195545 | A1 | 10/2004 | Gay | |
| 2007/0167531 | A1 | 7/2007 | Preston et al. | |
| 2009/0030222 | A1 | 1/2009 | Gibson et al. | |
| 2009/0084482 | A1 | 4/2009 | Majumdar et al. | |
| 2009/0170994 | A1 | 7/2009 | McConnell et al. | |
| 2010/0025625 | A1 | 2/2010 | Swift et al. | |

(Continued)

FOREIGN PATENT DOCUMENTS

| | | |
|---|---|---|
| CN | 101479351 A | 7/2009 |
| EP | 0 509 365 A2 | 10/1992 |

(Continued)

OTHER PUBLICATIONS

European Search Report for European Application No. 14738277, dated Feb. 12, 2016, 8 pages.
Vogt, Elżbieta, "Hydrophobization of fine solids presented on the example of limestone powder", Polish Journal of Chemical Technology, vol. 10, No. 1, 2008, pp. 49-51.
Vogt, E., and Opalinski, I., "The comparison of properties of hydrophobized limestone powders produced in different methods", Chemical Engineering Transactions, vol. 17, 2009, pp. 1711-1716.
Vogt, Elżbieta, "Hydrophobized Limestone Powder as an Antiexplosive Agent", Polish Journal of Environ. Stud., vol. 20, No. 3, 2011, pp. 801-804.
Polish Standard, PN-G-11020, 1994, Mining—Antiexplosive stone dust.
Polish Journal of Chemical Technology 10,1,49-51, 2008.
Polish J. of Environ Stud. vol. 20, No. 3 (2011) 801-804.

(Continued)

*Primary Examiner* — Ronak C Patel
(74) *Attorney, Agent, or Firm* — Finnegan, Henderson, Farabow, Garrett & Dunner, LLP

(57) ABSTRACT

A method for using a composition for use as rock dust in an underground mine is disclosed. The composition includes a fine, wet ground inorganic particulate material treated with at least one hydrophobic treatment, and a coarse, untreated, dry ground inorganic particulate material. Also disclosed is a composition including coal dust and mine rock dust including a fine, wet ground inorganic particulate material treated with at least one hydrophobic treatment, and a coarse, untreated, dry ground inorganic particulate material. The amount of mine rock dust may be sufficient to render the coal dust explosively inert according to at least one of a 20-L explosibility test or an ASTM E1515 explosibility test. The fine, wet ground inorganic particulate material may be calcium carbonate. The coarse, untreated inorganic particulate material may be calcium carbonate. The fatty acid may be stearic acid.

6 Claims, No Drawings

(56) References Cited

U.S. PATENT DOCUMENTS

| | | | |
|---|---|---|---|
| 2010/0193982 | A1 | 8/2010 | Genolet |
| 2012/0111583 | A1 | 5/2012 | Brown et al. |
| 2012/0181051 | A1 | 7/2012 | Masloff et al. |
| 2012/0227632 | A1 | 9/2012 | Kanduth et al. |
| 2013/0040235 | A1 | 2/2013 | Takatsuna |
| 2013/0277072 | A1 | 10/2013 | Van Buren |
| 2014/0193642 | A1 | 7/2014 | Anstine |
| 2015/0008369 | A1 | 1/2015 | Anstine |
| 2015/0037496 | A1 | 2/2015 | Wicks |

FOREIGN PATENT DOCUMENTS

| | | | |
|---|---|---|---|
| EP | 0 509 365 | A3 | 10/1992 |
| RU | 2 264 208 | C2 | 11/2005 |
| WO | WO 2006-060368 | A2 | 6/2006 |
| WO | WO 2010-030579 | A1 | 3/2010 |
| WO | WO 2013-020918 | | 2/2013 |

OTHER PUBLICATIONS

Berg, David, "Development of a New Hydrophobic Rock Dust", www.coalage.com., Sep. 2014, pp. 40-45.

Office Action issued in related U.S. Appl. No. 14/151,004, filed Jan. 9, 2014.

"Handbook of gas control and techniques in coal mine (revised edition)", edited by Yue Bu-fan, Coal Industry Press, pp. 158-161, published on Nov. 2005.

State Intellectual Property Office of People's Republic China Search Report dated Jun. 29, 2016, in corresponding Chinese Application No. 2014800133158 (3 pages).

International Search Report and Written Opinion for related International Application No. PCT/US2014/038633, dated Sep. 30, 2014.

* cited by examiner

NON-CAKING MINE ROCK DUST FOR USE IN UNDERGROUND COAL MINES

CROSS-REFERENCE TO RELATED APPLICATIONS

This application is a continuation of U.S. patent application Ser. No. 14/519,941, filed Oct. 21, 2014, which is a continuation of International Application No. PCT/US2014/059536, filed Oct. 7, 2014, which claims the benefit of priority of EP Application No. EP13290240.4, filed Oct. 7, 2013, and U.S. Provisional Application No. 61/897,907, filed Oct. 31, 2013. U.S. patent application Ser. No. 14/519,941 is also a continuation-in-part of U.S. patent application Ser. No. 14/151,004, filed Jan. 9, 2014, which claims the benefit of priority of U.S. Provisional Application No. 61/750,564, filed Jan. 9, 2013, and U.S. Provisional Application No. 61/787,654, filed Mar. 15, 2013. U.S. patent application Ser. No. 14/519,941 is also a continuation-in-part of U.S. patent application Ser. No. 14/281,610, filed May 19, 2014. The disclosures of each of these applications is incorporated herein by reference.

FIELD OF DISCLOSURE

Disclosed herein are compositions for use as rock dust to abate explosions in mines, such as coal mines.

BACKGROUND OF THE DISCLOSURE

For many years limestone-based rock dust has been the mine rock dust of choice for explosion abatement. Typically limestone mine rock dusts are readily available throughout North America and prevent the propagation of an explosion when applied in a proper manner to all mine surfaces and used in the correct proportion to the coal dust generated during the mining process.

However, in 2011, the National Institute of Occupation Safety and Health (NIOSH) reported that examinations of rock dust samples tended to cake when wetted and subsequently dried. The report revealed that the examined samples formed cakes and were not easily dispersed with the subjective requirement of a "light blast of air." The rock dust samples NIOSH analyzed contained very fine (e.g., less than 10 microns) particles. Fine particles enhance the caking potential of rock dust when wetted.

Therefore, it may be desirable to provide an economically-viable modified limestone-based rock dust that will be capable of passing the caking evaluation tests established by NIOSH and government regulations, and effectively inerting coal dust.

SUMMARY OF THE DISCLOSURE

According to a first aspect, a composition may include mine rock dust including a dry ground inorganic particulate material treated with at least one fatty acid, a salt thereof, or an ester thereof. The composition may further include an untreated inorganic particulate material.

According to another aspect, a composition may include coal dust and mine rock dust including a dry ground inorganic particulate material treated with at least one fatty acid, a salt thereof, or an ester thereof. The amount of mine rock dust may be sufficient to render the coal dust explosively inert. The composition may further include an untreated inorganic particulate material.

According to another aspect, a composition may include mine rock dust including an inorganic particulate material treated with at least one of a fatty acid, a salt thereof, or an ester thereof, silicone oil, silane, or siloxane. When the composition is treated with stearic acid, the inorganic particulate material may be a dry ground inorganic particulate material. The mine rock dust may further include an untreated inorganic particulate material.

According to another aspect, a composition may include coal dust and mine rock dust including an inorganic particulate material treated with at least one of a fatty acid, a salt thereof, or an ester thereof, silicone oil, silane, or siloxane. When the composition is treated with stearic acid, the inorganic particulate material may be a dry ground inorganic particulate material. The amount of mine rock dust may be sufficient to render the coal dust explosively inert. The composition may further include an untreated inorganic particulate material.

According to another aspect, a composition may include a mine rock dust that may pass a 20-L explosibility test.

According to a further aspect, a composition may include a mine rock dust that may pass ASTM E1515 explosibility test.

According to another aspect, a composition may include a mine rock dust that may render coal dust explosively inert.

According to another aspect, a composition may include a mine rock dust that may have a dispersion greater than or equal to about 0.1% by weight. According to some aspects, the dispersion may be by applying a light blast of air.

DESCRIPTION OF EXEMPLARY EMBODIMENTS

According to some embodiments, a composition may include a mine rock dust that may pass a 20-L explosibility test.

According some embodiments, a composition may include a mine rock dust that may pass ASTM E1515 explosibility test.

According to some embodiments, a composition may include a mine rock dust that may render coal dust explosively inert.

According to some embodiments, a composition may include a mine rock dust that may have a dispersion greater than or equal to about 0.1% by weight. According to some aspects, the dispersion may be by applying a light blast of air.

According to some embodiments, an anti-caking mine rock dust may include an inorganic particulate material (e.g., a mineral) treated with at least one surface treatment. The at least one surface treatment may include at least one of a fatty acid, a salt thereof, or an ester thereof, silicone oil, silane, or siloxane. The at least one surface treatment may impart hydrophobic or water-repellant properties to the inorganic particulate material.

According to some embodiments, a composition may include coal dust and mine rock dust including an inorganic particulate material treated with at least one fatty acid, a salt thereof, or an ester thereof, silicone oil, silane, or siloxane. The amount of mine rock dust may be sufficient to render the coal dust explosively inert.

In particular embodiments, the inorganic particulate material may include calcium carbonate, such as, for example, marble or limestone (e.g., ground calcite or ground dolomite). In some embodiments, the inorganic particulate material may include lime. Hereafter, certain embodiments of the invention may tend to be discussed in terms of calcium carbonate, and in relation to aspects where the calcium carbonate is processed and/or treated. The invention should not be construed as being limited to such embodiments. For instance, calcium carbonate may be replaced, either in whole or in part, with, for example, talc or lime.

In certain embodiments, at least one surface treatment is used to modify the surface of the inorganic particulate material. In one embodiment, the at least one surface treatment at least partially chemically modifies the surface of the inorganic particulate material by way of at least one surface treating agent. Chemical modification includes, but is not limited to, covalent bonding, ionic bonding, and "weak" intermolecular bonding, such as van der Waals' interactions. In some embodiments, the at least one surface treatment at least partially physically modifies the surface of the inorganic particulate material. Physical modification includes, but is not limited to, roughening of the material surface, pitting the material surface, or increasing the surface area of the material surface. In further embodiments, the at least one surface treatment at least partially chemically modifies and at least partially physically modifies the surface of the inorganic particulate material. In yet other embodiments, the at least one surface treatment is any chemical or physical modification to the surface of the inorganic particulate material.

In certain embodiments, the at least one fatty acid, salt thereof, or ester thereof may be one or more fatty acid, salt thereof, or ester thereof with a chain length of C16 or greater. The fatty acid may, for example, be stearic acid.

In some embodiments, the at least one surface treatment silanizes the inorganic particulate material. The silanizing surface treatment may include at least one siloxane. In general, siloxanes are any of a class of organic or inorganic chemical compounds comprising silicon, oxygen, and often carbon and hydrogen, based on the general empirical formula of $R_2SiO$, where R may be an alkyl group. Exemplary siloxanes include, but are not limited to, dimethylsiloxane, methylphenylsiloxane, methylhydrogen siloxane, methylhydrogen polysiloxane, methyltrimethoxysilane, octamethylcyclotetrasiloxane, hexamethyldisiloxane, diphenylsiloxane, and copolymers or blends of copolymers of any combination of monophenylsiloxane units, diphenylsiloxane units, phenylmethylsiloxane units, dimethylsiloxane units, monomethylsiloxane units, vinylsiloxane units, phenylvinylsiloxane units, methylvinylsiloxane units, ethylsiloxane units, phenylethylsiloxane units, ethylmethylsiloxane units, ethylvinylsiloxane units, or diethylsiloxane units.

In some embodiments, the silanizing surface treatment may include at least one silane. In general, silanes and other monomeric silicon compounds have the ability to bond to inorganic materials, such as the inorganic particulate material. The bonding mechanism may be aided by two groups in the silane structure, where, for example, the $Si(OR_3)$ portion interacts with the inorganic particulate material, while the organofunctional (vinyl-, amino-, epoxy-, etc.) group may interact with other materials.

In one embodiment, the inorganic particulate material is subjected to at least one surface treatment surface-treated with at least one ionic silane. Exemplary ionic silanes include, but are not limited to, 3-(trimethoxysilyl) propylethylenediamine triacetic acid trisodium salt and 3-(trihydroxysilyl)propylmethylposphonate salt. In another embodiment, the inorganic particulate material is subjected to at least one surface treatment with at least one nonionic silane.

In a further embodiment, the inorganic particulate material is subjected to at least one surface treatment with at least one silane of Formula (I):

$$(R^1)_xSi(R^2)_{3-x}R^3 \quad (I)$$

wherein:

$R^1$ is any hydrolysable moiety that may chemically react with any active group on the surface of the inorganic particulate material, including, but not limited to, alkoxy, halogen, hydroxy, aryloxy, amino, amide, methacrylate, mercapto, carbonyl, urethane, pyrrole, carboxy, cyano, aminoacyl, acylamino, alkyl ester, and aryl ester;

X has a value between 1 and 3, such that more than one siloxane bond may be formed between the inorganic particulate material and the at least one silane;

$R^2$ is any carbon-bearing moiety that does not substantially react or interact with the inorganic particulate material during the treatment process, including, but not limited to, substituted or unsubstituted alkyl, alkenyl, alkaryl, alkcycloalkyl, aryl, cycloalkyl, cycloalkenyl, heteroaryl, heterocyclic, cycloalkaryl, cycloalkenylaryl, alkcycloalkaryl, alkcycloalkenyaryl, and arylalkaryl;

$R^3$ is any organic-containing moiety that remains substantially chemically attached to the silicon atom of Formula (I) once the at least one surface treatment is completed and that is capable of reacting or interacting with an active ingredient, such as, but not limited to, hydrogen, alkyl, alkenyl, alkaryl, alkcycloalkyl, aryl, cycloalkyl, cycloalkenyl, heteroaryl, heterocyclic, cycloalkaryl, cycloalkenylaryl, alkcycloalkaryl, alkcycloalkenyaryl, arylalkaryl, alkoxy, halogen, hydroxy, aryloxy, amino, amide, methacrylate, mercapto, carbonyl, urethane, pyrrole, alkyl ester, aryl ester, carboxy, sulphonate, cyano, aminoacyl, acylamino, epoxy, phosphonate, isothiouronium, thiouronium, alkylamino, quaternary ammonium, trialkylammonium, alkyl epoxy, alkyl urea, alkyl imidazole, or alkylisothiouronium; wherein the hydrogen of said alkyl, alkenyl, aryl, cycloalkyl, cycloalkenyl, heteroaryl, and heterocyclic is optionally substituted by, for example, halogen, hydroxy, amino, carboxy, or cyano.

In another embodiment, the inorganic particulate material with a hydroxyl-bearing porous surface is subjected to at least one surface treatment with at least one silane, such that the inorganic particulate material surface is chemically bonded to the at least one silane. In such an embodiment, the surface area of the inorganic particulate material may limit the amount of the bound silane. As a result, it may be preferable to subject the inorganic particulate material to at least one physical surface treatment that increases the surface area of the inorganic particulate material prior to treatment with the at least one silane.

In some embodiments, silanization may proceed according to "wet" or "dry" processes known to the skilled artisan. For example, a "wet" process generally includes reacting the at least one silane onto the inorganic particulate material in at least one solvent (e.g., organic solvent or water). In some embodiments, heat may used in place of, or in addition to, the at least one solvent. Although heat and solvents are not required for a "wet" process, they may improve the reaction rate and promote uniform surface coverage of the treatment. In another embodiment, a "wet" process includes in-line mixing of slurries or liquids during typical silanization processing steps, including but not limited to filtration and drying.

In some embodiments, a "dry" silanization process generally includes reacting at least one silane with the inorganic particulate material in a vapor phase by mixing the at least one silane with the inorganic particulate material and then heating the mixture. In some embodiments, a "dry" silanization process includes reacting at least one silane with the inorganic particulate material in a stirred liquid phase by mixing the at least one silane with the inorganic particulate material and then heating the mixture. In still other embodiments, a "dry" silanization process includes mixing at least one silane with the inorganic particulate material and incubating in a sealed container at elevated temperatures to speed up the surface treatment process. In yet other embodiments, the "dry" silanization process includes mixing the inorganic particulate material and a liquid silane additive, where the amount of silane added is small enough that the reaction mass remains solid-like and can continue to be processed like a dry particulate material.

In one embodiment, the inorganic particulate material is subjected to at least one surface treatment with at least one silane by adding the at least one silane gradually to a rapidly stirred solvent, which is in direct contact with the inorganic particulate material. In another embodiment, the inorganic particulate material is subjected to at least one surface treatment with at least one silane by carrying out the treatment in a vapor phase, which causes the vapor of the at least one silane to contact and react with the inorganic particulate material.

According to some embodiments, a surface treatment, such as, for example, silicone oil, siloxane, or silane, may polymerize onto the inorganic particulate material. The treated inorganic particulate material may then be deagglomerated, if needed.

In certain embodiments, the inorganic particulate material may have a Hegman of about 5.5 or less, as measured by ASTM D1210.

In some embodiments, the inorganic particulate material may have a brightness of 95 or less, as measured using Hunter Colorimeter Models D-25A-9 or DP 9000.

In some embodiments, the inorganic particulate material may have a BET surface area of at least about 0.3 square meters/gram. For example, the inorganic particulate material may have a BET surface area of at least about 0.4 square meters/gram, at least about 0.5 square meters/gram, or at least about 0.6 square meters/gram.

In some embodiments, the inorganic particulate material may be a ground inorganic particulate material, such as a dry ground treated inorganic particulate material or a wet ground treated inorganic particulate material.

In certain embodiments, the mine rock dust may also include an untreated inorganic particulate material blended with the treated inorganic particulate material. In particular embodiments, the anti-caking mine rock dust may include a blend of coarse untreated inorganic particulate material such as, for example, talc, limestone (e.g., ground calcium carbonate (GCC), ground calcite, ground dolomite), chalk, marble, and fine treated inorganic particulate material such as talc, lime, limestone (e.g., GCC, ground calcite, ground dolomite). In other embodiments, the untreated inorganic particulate may include lime, gypsum, diatomaceous earth, perlite, hydrous or calcined kaolin, attapulgite, bentonite, montmorillonite, and other natural or synthetic clays. In some embodiments, blending a fine treated ground limestone with a coarser untreated limestone results in a mine rock dust that exhibits some hydrophobic properties and less caking when put in contact with water versus untreated limestone alone.

The effectiveness of certain embodiments of the mine rock dust in inerting coal dust may be shown by explosibility tests, such as, for example, the 20-L explosibility test or ASTM E1515. According to some embodiments, the mine rock dust may pass a 20-L explosibility test. According to some embodiments, the mine rock dust may satisfy ASTM E1515. According to some embodiments, the mine rock dust may render coal dust explosively inert.

In some embodiments, the amount of dispersion may be measured by applying a light blast of air, as per 30 C.F.R. § 75.2. According to some embodiments, the light blast of air may be applied after the mine rock dust has been wetted and dried. According to some embodiments, the mine rock dust will not form a cake that will not be dispersed into separate particles by a light blast of air. The amount of dispersion may be measured by the amount of weight of powder lost relative to the amount of powder prior to dispersing.

According to some embodiments, the mine rock dust may have an amount of dispersion greater than or equal to about 0.1% by weight. For example, the mine rock dust may have an amount of dispersion greater than or equal to about 1% by weight, greater than or equal to about 2% by weight, greater than or equal to about 3% by weight, greater than or equal to about 4% by weight, greater than or equal to about 5% by weight, greater than or equal to about 6% by weight, greater than or equal to about 7% by weight, greater than or equal to about 8% by weight, greater than or equal to about 9% by weight, greater than or equal to about 10% by weight, greater than or equal to about 11% by weight, greater than or equal to about 12% by weight, greater than or equal to about 13% by weight, greater than or equal to about 14% by weight, greater than or equal to about 15% by weight, greater than or equal to about 16% by weight, greater than or equal to about 17% by weight, greater than or equal to about 18 by weight, greater than or equal to about 19% by weight, greater than or equal to about 20% by weight, greater than or equal to about 21% by weight, greater than or equal to about 22% by weight, greater than or equal to about 23% by weight, greater than or equal to about 24% by weight, greater than or equal to about 25% by weight, greater than or equal to about 26% by weight, greater than or equal to about 27% by weight, greater than or equal to about 28% by weight, greater than or equal to about 29% by weight, or greater than or equal to about 30% by weight. According to some embodiments, the dispersion may be determined after 0 days, 7 days, 14 days, or 21 days after placing the mine rock dust in a chamber, such as, for example, a humidity chamber, dispersion testing chamber, or mine.

According to some embodiments, the anti-caking properties of the mine rock dust may be measured using a Proctor test, such as ASTM D698-12. When measured using a Proctor test, the mine rock dust may fail to incorporate water. For example, the mine rock dust may fail to incorporate water such that it does not clump or hold together sufficiently to conduct the Proctor test. The mine rock dust may not pack or mix when subjected to a proctor test.

According to some embodiments, the mine rock dust may include a treated inorganic particulate material. According to some embodiments, the mine rock dust may include an untreated inorganic particulate material.

According to some embodiments, the mine rock dust may include a blended mine rock dust. The blended mine rock dust may include a treated inorganic particulate material. The blended mine rock dust may also include an untreated inorganic particulate material.

According to some embodiments, the mine rock dust may have a moisture pick-up of less than or equal to about 10% by weight relative to the starting weight of the mine rock dust. For example, the mine rock dust may have a moisture pick-up less than or equal to about 9% by weight, less than or equal to about 8% by weight, less than or equal to about 7% by weight, less than or equal to about 6% by weight, less than or equal to about 5% by weight, less than or equal to about 4% by weight, less than or equal to about 3% by weight, less than or equal to about 2% by weight, less than or equal to about 1% by weight relative to the starting weight of the mine rock dust. The moisture pick-up may be determined, for example, 7 days, 14 days, or 21 days after the mine rock dust is placed into a humidity chamber.

In some embodiments, the untreated inorganic particulate material may be ground inorganic particulate material, such as a dry ground inorganic particulate material or a wet ground inorganic particulate material.

In some embodiments, the blended treated inorganic particulate material and untreated inorganic particulate material has a range of contact angles from about 10 to about 150 degrees. According to some embodiments, the blended material has a range of contact angles from about 25 to about 125 degrees, from about 50 to about 100 degrees, or from 90 to about 150 degrees.

Without wishing to be bound by a particular theory, it is believed that the ratio of the treated inorganic particulate material to untreated inorganic particulate material may be proportioned to vary the amount of un-reacted surface treatment in the blends. In certain embodiments, surface-treated ground calcium carbonate may be used to provide a hydrophobic property to the rock dust. Without wishing to be bound by a particular theory, addition of a surface treatment, such as stearic acid, may result in minimal "free acid" after treatment. The reaction of stearic acid with the limestone surface may create calcium or magnesium stearate. The melting point of stearic acid is approximately 157° F. (69.4° C.), and the melting point of calcium stearate is approximately 311° F. (155° C.).

According to some embodiments, calcium carbonate is combined (e.g., blended) at room temperature with stearic acid (or salts thereof, esters thereof, or mixtures thereof) and water in an amount greater than about 0.1% by weight relative to the total weight of the mixture (e.g., in the form of a cake-mix). The mixture may be blended at a temperature sufficient for at least a portion of the stearic acid to react (e.g., sufficient for a majority of the stearic acid to react with at least a portion of the calcium carbonate). For instance, the mixture may be blended at a temperature sufficient such that at least a portion of the stearic acid may coat at least a portion of the calcium carbonate (e.g., the surface of the calcium carbonate).

In some embodiments, the mixture may be blended at a temperature high enough to melt the stearic acid. For example, the mixture may be blended at a temperature ranging from about 149° F. (65° C.) to about 392° F. (200° C.). In other embodiments, the mixture may be blended at a temperature ranging from about 149° F. (65° C.) to about 302° F. (150° C.), for example, at about 248° F. (120° C.). In further embodiments, the mixture may be blended at a temperature ranging from about 149° F. (65° C.) to about 212° F. (100° C.). In still other embodiments, the mixture may be blended at a temperature ranging from about 149° F. (65° C.) to about 194° F. (90° C.). In further embodiments, the mixture may be blended at a temperature ranging from about 158° F. (70° C.) to about 194° F. (90° C.).

In certain embodiments, the amount of surface treatment may be combined with the inorganic particulate material, such as, for example, calcium carbonate, below, at, or in excess of, a monolayer concentration. "Monolayer concentration," as used herein, refers to an amount sufficient to form a monolayer on the surface of the inorganic particles. Such values will be readily calculable to one skilled in the art based on, for example, the surface area of the inorganic particles.

In some embodiments, the surface treatment may be added to calcium carbonate in an amount greater than or equal to about one times the monolayer concentration. In other embodiments, the surface treatment may be added in an amount in excess of about one times the monolayer concentration, for example, two times to six times the monolayer concentration.

Also, without wishing to be bound by a particular theory, the median particle sizes of the coarse untreated portions of the mine rock dusts may be chosen based on their potential to pack with the median particle size of the specific treated fine portions of the rock dust used in that blend. The advantage of blending the smaller particles with the larger particles is that the voids between the larger particles that would wick moisture into the blend are reduced or avoided. In certain embodiments, particle-packing practice may be used to inhibit the wicking action of surface water through the compositions.

In certain embodiments, the inorganic particles may be characterized by a mean particle size ($d_{50}$) value, defined as the size at which 50 percent of the calcium carbonate particles have a diameter less than or equal to the stated value. Particle size measurements, such as $d_{50}$, may be carried out by any means now or hereafter known to those having ordinary skill in the art.

Particle sizes, and other particle size properties, of the untreated inorganic particulate material referred to in the present disclosure, may be measured using a SEDIGRAPH 5100 instrument, as supplied by Micromeritics Corporation. The size of a given particle is expressed in terms of the diameter of a sphere of equivalent diameter, which sediments through the suspension, i.e., an equivalent spherical diameter or esd.

The particle size and other particle size properties of the treated inorganic particulate material may be determined by a Microtrac Model X100 Particle Size Analyzer, as supplied by Microtrac. The Microtrac analysis determines particle size based on the number distribution of particles using a laser light scattering technique.

In some embodiments, the particle size as determined by SEDIGRAPH 5100 may not be the same as that determined by a Microtrac Model X100 Particle Size Analyzer. The difference may be due to the different methods used by each instrument to determine the particle size. The SEDIGRAPH 5100 measures the sedimentation of particles over time, whereas the Microtrac Model X100 Particle Size Analyzer analyzes a laser light scattering pattern using a specific algorithm.

According to some embodiments, the amount of free stearic acid associated with a stearic acid-treated calcium carbonate composition may be less than about 20% relative to the monolayer concentration. According to other embodiments, the amount of free stearic acid associated with a stearic acid-treated calcium carbonate composition may be less than about 15% free stearic acid. According to further embodiments, the amount of free stearic acid associated with a stearic acid-treated calcium carbonate composition may be less than about 10% free stearic acid, less than about 7% free stearic acid, less than about 6% free stearic acid, less than about 5% free stearic acid, less than about 4% free stearic acid, less than about 3% free stearic acid, less than about 2% free stearic acid, or less than about 1% free stearic acid. In still further embodiments, no free stearic acid may be associated with a stearic acid-treated calcium carbonate composition. "No free stearic acid," as used herein, refers to no stearic acid being detectable by the ToF-SIMS, TGA, and/or DSC techniques described herein.

According to some embodiments, the treated inorganic particulate material and the untreated inorganic particulate material have the same particle size distribution (psd). The psd of the fine particles may be similar to, or the same as, the psd of the coarse portion of the mine rock dust.

An exemplary anti-caking mine rock dust is now described. The mine rock dust may be such that a minimum of 70% of the particles passes through a 200 mesh. In some embodiments, the $d_{50}$ ranges from about 10 to about 50 microns; no more than about 0.4 wt % stearic acid is present (without wishing to be bound by a particular theory, too much stearic acid may affect whether the mine rock dust will adhere properly to the mine walls and ceilings); and the ratio of the fine treated portion to the coarse untreated portion ranges from 10:90 to 75:25. The fine portion may be treated with stearic acid, silicone oil, siloxane, or silane. For the stearic acid treatment, it is preferred to have reacted stearate on the inorganic particulate material, as it has a higher melting point (311° F.) relative to unreacted (free) stearic acid (157° F.). By having less of the lower melting point material, less flashing of the treatment occurs during an explosion or increase in temperature when the composition is in use. Thus, the rock mine dust will be more effective in abating an explosion.

In certain embodiments, the treatment level ranges from 0.01 wt % to 5.0 wt %, for example, from 0.1 wt % to 2.5 wt % based on the weight of the inorganic particulate material.

For instance, the fatty acid, salt thereof, or ester thereof may be present in treatment level ranges from 0.1 wt % to 2.5 wt % based on the weight of the inorganic particulate material. The fatty acid, salt thereof, or ester thereof may be present in an amount of not more than 0.2 wt %, not more than 0.3 wt %, not more than 0.4 wt %, not more than 0.5 wt %, not more than 0.6 wt %, not more than 0.7 wt %, not more than 0.8 wt %, not more than 0.9 wt %, not more than 1.0 wt %, not more than 1.1 wt %, not more than 1.2 wt %, not more than 1.25 wt %, not more than 1.3 wt %, not more than 1.4 wt %, not more than 1.5 wt %, not more than 1.6 wt %, not more than 1.7 wt %, not more than 1.8 wt %, not more than 1.9 wt %, not more than 2.0 wt %, not more than 2.1 wt %, not more than 2.2 wt %, not more than 2.3 wt %, not more than 2.4 wt %, or not more than 2.5 wt % based on the weight of the inorganic particulate material.

For instance, the silicone oil, siloxane, or silane may be present in treatment level ranges from 0.01 wt % to 5.0 wt % based on the weight of the inorganic particulate material. The silicon oil, siloxane, or silane may be present in an amount of not more than 0.05 wt %, not more than 0.1 wt %, not more than 0.2 wt %, not more than 0.3 wt %, not more than 0.4 wt %, not more than 0.5 wt %, not more than 0.6 wt %, not more than 0.7 wt %, not more than 0.8 wt %, not more than 0.9 wt %, not more than 1.0 wt %, not more than 1.1 wt %, not more than 1.2 wt %, not more than 1.25 wt %, not more than 1.3 wt %, not more than 1.4 wt %, not more than 1.5 wt %, not more than 1.6 wt %, not more than 1.7 wt %, not more than 1.8 wt %, not more than 1.9 wt %, not more than 2.0 wt %, not more than 2.1 wt %, not more than 2.2 wt %, not more than 2.3 wt %, not more than 2.4 wt %, not more than 2.5 wt %, not more than 3.0 wt %, not more than 3.5 wt %, not more than 4.0 wt %, not more than 4.5 wt %, or not more than 5.0 wt % based on the weight of the inorganic particulate material.

In certain embodiments, the fine treated inorganic particulate material $d_{50}$ ranges from 1 to 15 microns. In other embodiments, the fine treated inorganic particulate material $d_{50}$ ranges from 0.5 to 75 microns, from 1 to 60 microns, from 1 to 50 microns, or from 1 to 30 microns.

In certain embodiments, the ratio of treated inorganic particulate material to untreated inorganic particulate material ranges from about 1:99 to about 99:1, for example, from about 3:97 to about 97:3, 5:95 to about 95:5, from about 10:90 to about 90:10, from about 20:80 to about 80:20, from about 25:75 to about 75:25, or less than about 50:50.

According to some embodiments, the untreated inorganic particulate material $d_{50}$ ranges from 3 to 75 microns, for example, from 10 to 75 microns, from 12 to 75 microns, from 20 to 75 microns, from 25 to 75 microns, from 30 to 75 microns, from 5 to 50 microns, or from 10 to 50 microns.

Three example mine rock dusts may be prepared according to the exemplary methods disclosed herein:

1. 50% coarse (12-18 micron) ground limestone with 50% 3 micron median stearate-treated ground limestone blend;
2. 25% coarse (12-18 micron) ground limestone with 75% 3 micron median stearate-treated ground limestone blend; and
3. 75% coarse (12-18 micron) ground limestone with 25% 3 micron median stearate-treated ground limestone blend.

In some embodiments, the ground calcium carbonate is prepared by attrition grinding. "Attrition grinding," as used herein, refers to a process of wearing down particle surfaces resulting from grinding and shearing stress between the moving grinding particles. Attrition can be accomplished by rubbing particles together under pressure, such as by a gas flow.

In some embodiments, the attrition grinding is performed autogenously, where the calcium carbonate particles are ground only by other calcium carbonate particles.

In another embodiment, the calcium carbonate is ground by the addition of a grinding media other than calcium carbonate. Such additional grinding media can include ceramic particles (e.g., silica, alumina, zirconia, and aluminum silicate), plastic particles, or rubber particles.

In some embodiments, the calcium carbonate is ground in a mill. Exemplary mills include those described in U.S. Pat. Nos. 5,238,193 and 6,634,224, the disclosures of which are incorporated herein by reference. As described in these patents, the mill may comprise a grinding chamber, a conduit for introducing the calcium carbonate into the grinding chamber, and an impeller that rotates in the grinding chamber thereby agitating the calcium carbonate.

In some embodiments, the calcium carbonate is dry ground, where the atmosphere in the mill is ambient air. In some embodiments, the calcium carbonate may be wet ground.

In some embodiments, the mine rock dust may have a range of contact angles from 10 to 150 degrees, from 25 to 125 degrees, from 50 to 100 degrees, or from 90 to 150 degrees, as measured by a test according to ASTM D7334-08. For example, a stearate-treated calcium carbonate may be blended with an untreated calcium carbonate in a ratio (treated:untreated) of 12.5:87.5. The treated calcium carbonate may be treated with 1.15 wt % of stearate and may have a $d_{50}$ value of 3.3 microns, as measured by Microtrac laser light diffraction. The untreated calcium carbonate may have a $d_{50}$ value of 22.5 microns, as measured by a SEDIGRAPH 5100. The contact angle of the blended composition may be measured according to ASTM D7334-08. The exemplary blended composition has a contact angle of 93 degrees at 35% relative humidity, and 95.5 degrees at 98% relative humidity.

In some embodiments, a feed calcium carbonate (prior to milling) may comprise calcium carbonate sources chosen from calcite, limestone, chalk, marble, dolomite, or other similar sources. Ground calcium carbonate particles may be prepared by any known method, such as by conventional grinding techniques discussed above and optionally coupled with classifying techniques, e.g., jaw crushing followed by roller milling or hammer milling and air classifying or mechanical classifying.

The ground calcium carbonate may be further subjected to an air sifter or hydrocyclone. The air sifter or hydrocyclone can function to classify the ground calcium carbonate and remove a portion of residual particles greater than 20 microns. According to some embodiments, the classification can be used to remove residual particles greater than 10 microns, greater than 30 microns, greater than 40 microns, greater than 50 microns, or greater than 60 microns. According to some embodiments, the ground calcium carbonate may be classified using a centrifuge, hydraulic classifier, or elutriator.

In some embodiments, the ground calcium carbonate disclosed herein is free of dispersant, such as a polyacrylate. In another embodiment, a dispersant may be present in a sufficient amount to prevent or effectively restrict flocculation or agglomeration of the ground calcium carbonate to a desired extent, according to normal processing requirements. The dispersant may be present, for example, in levels up to about 1% by weight. Examples of dispersants include polyelectrolytes such as polyacrylates and copolymers containing polyacrylate species, especially polyacrylate salts (e.g., sodium and aluminium optionally with a group II metal salt), sodium hexametaphosphates, non-ionic polyol, polyphosphoric acid, condensed sodium phosphate, non-ionic surfactants, alkanolamine, and other reagents commonly used for this function.

A dispersant may be selected from conventional dispersant materials commonly used in the processing and grinding of inorganic particulate materials, such as calcium carbonate. Such dispersants will be recognized by those skilled in this art. Dispersants are generally water-soluble salts capable of supplying anionic species, which in their effective amounts may adsorb on the surface of the inorganic particles and thereby inhibit aggregation of the particles. The unsolvated salts may suitably include alkali metal cations, such as sodium. Solvation may in some cases be assisted by making the aqueous suspension slightly alkaline. Examples of suitable dispersants also include water soluble condensed phosphates, for example, polymetaphosphate salts (general form of the sodium salts: $(NaPO_3)_x$), such as tetrasodium metaphosphate or so-called "sodium hexametaphosphate" (Graham's salt); water-soluble salts of polysilicic acids; polyelectrolytes; salts of homopolymers or copolymers of acrylic acid or methacrylic acid; and/or salts of polymers of other derivatives of acrylic acid, suitably having a weight average molecular mass of less than about 20,000. Sodium hexametaphosphate and sodium polyacrylate, the latter suitably having a weight average molecular mass in the range of about 1,500 to about 10,000, are preferred.

In certain embodiments, the production of the ground calcium carbonate includes using a grinding aid, such as propylene glycol, or any grinding aid known to those skilled in the art.

According to some embodiments, the ground calcium carbonate may be combined with coal dust. At least some of the ground calcium carbonate compositions disclosed may effectively render coal dust inert, as shown by an explosibility test.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A composition comprising: coal dust; and dispersible non-caking mine dust comprising: a fine, wet ground inorganic particulate material coated with a hydrophobic treatment; and a coarse, untreated, dry inorganic particulate material, wherein particle packing of the fine, wet ground inorganic particulate material into voids between the coarse, untreated, dry inorganic particulate material reduces moisture wicking into the mine dust; wherein, after contact with water, the mine dust remains dispersible to render the coal dust explosively inert according to at least one of a 20-L explosibility test or an ASTM e1515 explosibility test; wherein the hydrophobic treatment comprises a surface treatment with at least one fatty acid, a salt thereof, or an ester thereof; and wherein the ratio of treated inorganic particulate material to untreated inorganic particulate material ranges from about 5:95 to about 95:5.

2. The composition of claim 1, wherein the treated inorganic particulate material has a contact angle ranging from 90 to about 150 degrees.

3. The composition of claim 1, wherein the fine, wet ground inorganic particulate material comprises a ground calcium carbonate.

4. The composition of claim 1, wherein the coarse, untreated, dry inorganic particulate material comprises a ground calcium carbonate.

5. The composition of claim 1, wherein the fine, wet ground inorganic particulate material has a $d_{50}$ ranging from about 1 to about 75 microns.

6. The composition of claim 1, wherein the at least one fatty acid comprises a stearic acid.

* * * * *